US010198907B2

(12) United States Patent
Chan et al.

(10) Patent No.: US 10,198,907 B2
(45) Date of Patent: Feb. 5, 2019

(54) GAMING SYSTEM AND A METHOD OF GAMING

(71) Applicant: Aristocrat Technologies Australia Pty Limited, North Ryde, NSW (AU)

(72) Inventors: Matthew Chan, East Killara (AU); Lipi Gupta, Newington (AU)

(73) Assignee: ARISTOCRAT TECHNOLOGIES AUSTRALIA PTY LIMITED (AU)

( * ) Notice: Subject to any disclaimer, the term of this patent is extended or adjusted under 35 U.S.C. 154(b) by 0 days.

(21) Appl. No.: 15/670,991

(22) Filed: Aug. 7, 2017

(65) Prior Publication Data

US 2018/0040196 A1 Feb. 8, 2018

(30) Foreign Application Priority Data

Aug. 8, 2016 (AU) ..... 2016903114

(51) Int. Cl.
*G07F 17/32* (2006.01)

(52) U.S. Cl.
CPC ..... *G07F 17/3244* (2013.01); *G07F 17/326* (2013.01); *G07F 17/3209* (2013.01); *G07F 17/3213* (2013.01); *G07F 17/3225* (2013.01)

(58) Field of Classification Search
USPC ..... 463/20
See application file for complete search history.

(56) References Cited

U.S. PATENT DOCUMENTS

2010/0222127 A1* 9/2010 Finch ..... G07F 17/3262 463/20
2013/0260860 A1* 10/2013 Burczyk ..... G07F 17/3213 463/20

* cited by examiner

*Primary Examiner* — Pierre E Elisca
(74) *Attorney, Agent, or Firm* — McAndrews, Held & Malloy, Ltd.

(57) ABSTRACT

A gaming machine is disclosed that comprises a selector configured to select a plurality of symbols from a set of symbols for display in respective display positions in a display area, and a display position selector configured to select at least one display position. The system also has a function allocator configured to allocate a WILD function to each symbol displayed at a selected display position and to allocate a WILD function to each displayed symbol that is the same as a symbol displayed at a selected display position. An outcome evaluator determines a game outcome based on the displayed symbols and the or each allocated WILD function, and an award allocator allocates an award based on the game outcome determined by the outcome evaluator. A corresponding method is also disclosed.

24 Claims, 8 Drawing Sheets

GAMING SYSTEM AND A METHOD OF GAMING

RELATED APPLICATIONS

This application claims priority to Australia Provisional Patent Application No. 2016903114 having an International filing date of Aug. 8, 2016, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

It is known to provide a gaming system arranged to randomly display several symbols from a predetermined set of symbols and to determine a game outcome such as a game win based on the displayed symbols.

Such gaming systems may commonly be implemented as a stepper machine provided with reels with each reel carrying several symbols of the set, or a video machine wherein selected symbols are displayed on virtual reels on a graphical display device.

BRIEF SUMMARY OF THE INVENTION

In accordance with a first aspect of the present invention, there is provided a gaming system comprising:

a selector arranged to select a plurality of symbols from a set of symbols for display in respective display positions in a display area;

a display position selector arranged to select at least one display position;

a function allocator arranged to allocate a WILD function to each symbol displayed at a selected display position and to allocate a WILD function to each displayed symbol that is the same as a symbol displayed at a selected display position;

an outcome evaluator arranged to determine a game outcome based on the displayed symbols and the or each allocated WILD function; and an award allocator arranged to allocate an award based on the game outcome determined by the outcome evaluator.

In an embodiment, the symbols are displayed in a plurality of display position groups, and the display position selector is arranged to selects at least one display position from a defined one or more of the display position groups.

In an embodiment, the symbols are displayed in a plurality of display position groups, for example associated with a respective plurality of rotatable reels, and the system is arranged to select one or more of the display position groups from which the display position selector selects at least one display position.

The system may be arranged to randomly select one or more of the display position groups.

In an embodiment, the display position selector is arranged to determine the number of display position selections, for example randomly.

In an embodiment, the display position selector is arranged to randomly select the display positions.

In an embodiment, the system is arranged to modify the appearance of the symbols displayed at the selected display positions.

In an embodiment, the system is arranged to modify the appearance of a displayed symbol that is the same as a symbol displayed at a selected display position.

The symbol appearance may be modified by changing the colour of the symbol.

In an example, the system is arranged to display an animation to indicate the display positions that have been selected.

In accordance with a second aspect of the present invention, there is provided a method of gaming comprising:

selecting a plurality of symbols from a set of symbols for display in respective display positions in a display area;

selecting at least one display position;

allocating a WILD function to each symbol displayed at a selected display position;

allocating a WILD function to each displayed symbol that is the same as a symbol displayed at a selected display position;

determining a game outcome based on the displayed symbols and the or each allocated WILD function; and allocating an award based on the game outcome determined by the outcome evaluator.

In accordance with a third aspect of the present invention there is provided a computer program arranged when loaded into a computer to instruct the computer to operate in accordance with the gaming system of the first aspect.

BRIEF DESCRIPTION OF SEVERAL VIEWS OF THE DRAWINGS

In order that the present invention may be more clearly ascertained, embodiments of the present invention will now be described, by way of example only, with reference to the accompanying drawings, in which.

DETAILED DESCRIPTION OF THE INVENTION

Figure 1:
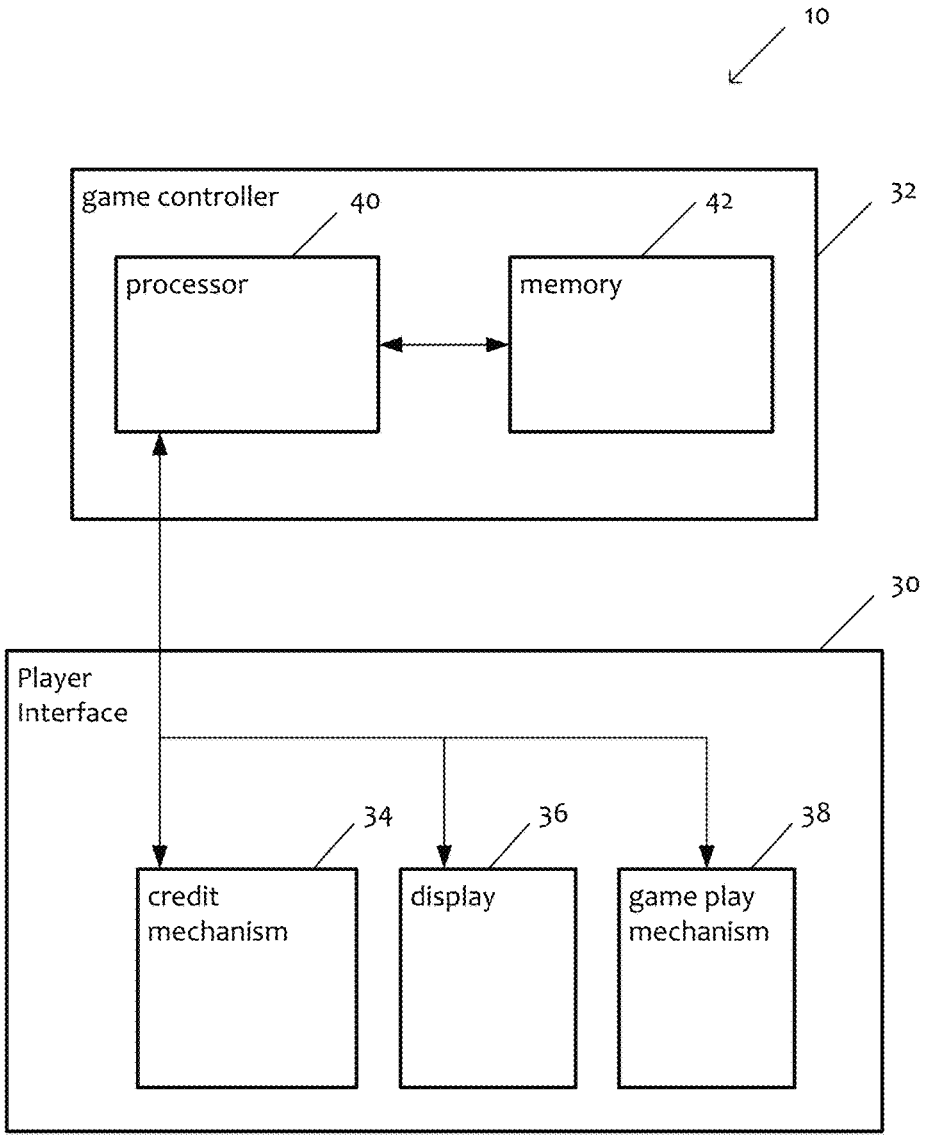
FIG. 1 is a schematic block diagram of components of a gaming system in accordance with an embodiment of the present invention.

The present gaming system operates such that during game play, a plurality of symbols are randomly selected from a set of symbols and displayed in a corresponding plurality of display position groups, each of which comprises a plurality of display positions. The symbols shown at the display positions are used to determine game outcomes by comparing the displayed symbols with defined winning combinations.

In one conventional type of gaming machine, a display area including 15 display positions is presented to a player with each display position including one symbol. The display positions are arranged in five vertically disposed display position groups, with each display position group corresponding to a rotatable reel, and each reel having three visible display positions. After the reels are spun and subsequently stopped, the display positions show a random selection of symbols.

Generally, with such games, a plurality of win patterns in the form of win lines are defined which extend across the reels and include one display position from each reel. Typically the symbols that are disposed in a win line are compared with winning symbol combinations defined in a pay table so as to determine whether a player of the game should receive an award. For example, if winning symbol combinations are based on poker hands, a particular prize would be awarded if the win line comprises four aces. Other winning symbol combinations and corresponding prizes may also be defined.

Such a game often comprises normal game mode and special game mode. During normal game mode, the displayed symbols are compared with winning combinations defined in a pay table. During special game mode, a feature game that is different to the base game is typically implemented.

With the present system, during implementation of a base game and/or a feature game, a trigger event causes at least one display position to be selected, and the symbol(s) at the selected display position(s) to acquire a WILD function. The system also operates to cause other displayed symbols that are the same as the symbol(s) in the selected display position(s) to acquire a WILD function. In this way, functions are applied to at least one displayed symbol based on selection of display positions and independently of the displayed symbols.

Referring to the drawings, there is shown a schematic block diagram of a gaming system 10 arranged to implement a probabilistic game of the type wherein several symbols from a set of symbols are randomly displayed, and a game outcome is determined on the basis of the displayed symbols. The system is of the type including multiple game modes, such as being operable in normal game mode wherein a base game is implemented and special game mode wherein a feature game is implemented.

With some such probabilistic games, the set of symbols used during normal game mode include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display along a win line, or are displayed according to defined outcome patterns such as scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions. The function symbol may be such that when the function symbol appears in a winning outcome, a defined multiplier is applied to the award value.

Referring to FIG. 1, a schematic diagram of components of a gaming system 10 in accordance with the present embodiment is shown. The components comprise a player interface 30 and a game controller 32. The player interface 30 is arranged to enable interaction between a player and the gaming system and for this purpose includes input/output components required for the player to enter instructions and play the game.

Components of the player interface 30 may vary but will typically include a credit mechanism 34 to enable a player to input credits and receive payouts, one or more displays 36 which may comprise a touch screen, and a game play mechanism 38 arranged to enable a player to input game play instructions.

The game controller 32 is in data communication with the player interface 30 and typically includes a processor 40 arranged to process game play instructions and output game player outcomes to the display 36. Typically, the game play instructions are stored as program code in a memory 42 that can also be hardwired. It will be understood that in this specification the term "processor" is used to refer generically to any device that can process game play instructions and may include a microprocessor, microcontroller, programmable logic device or other computational device such as a personal computer or a server.

Figure 2:
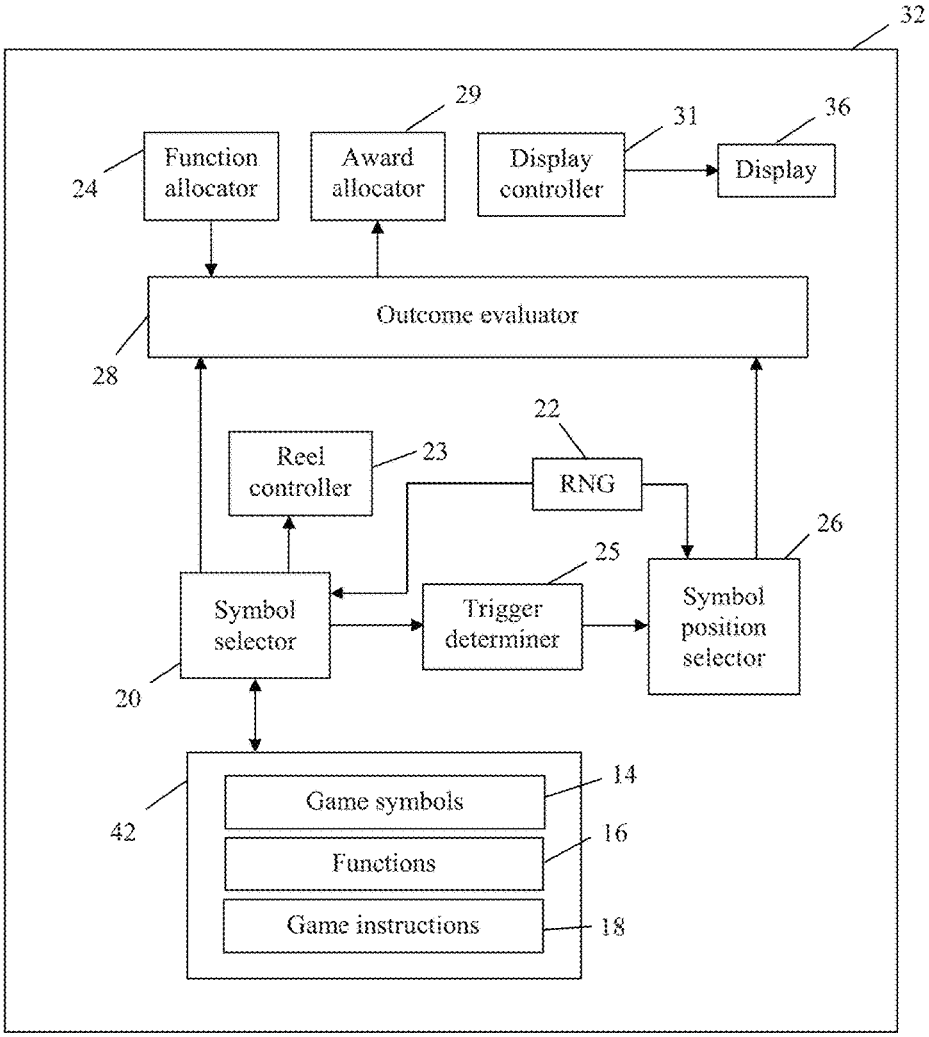
FIG. 2 is a schematic block diagram of functional components of a gaming system in accordance with an embodiment of the present invention.

A functional diagram illustrating operative components of the game controller 32 is shown in FIG. 2.

The memory 42 is arranged to store symbols data 14 indicative of a plurality of symbols, in the present example associated with a plurality of reels, function data 16 indicative of functions that are applicable to defined symbols, and game instruction data 18 indicative of game instructions usable by the gaming machine 10 to control operation of the system during normal game mode and special game mode.

The game controller 32 includes a symbol selector 20 which is arranged to select several symbols from the available symbols 14 for display to a player in a plurality of display positions, in this example by spinning reels containing the symbols and stopping the reels so as to display at least one symbol on each reel. In this example, the selection carried out by the symbol selector 20 is made using a random number generator 22.

It will be appreciated that the random number generator 22 may be of a type which is arranged to generate pseudo random numbers based on a seed number, and that in this specification the term "random" will be understood accordingly to mean truly random or pseudo random.

The symbol selector 20 interfaces with a reel controller 23 arranged to control and coordinate the reels, and in particular to control the stopping positions of the reels.

The game controller 32 also includes a function allocator 24 arranged to apply a function during game play, in particular a WILD function, and/or other functions such as an award multiplier.

With this embodiment, the game controller 32 also comprises a trigger determiner 25 arranged to determine whether a trigger condition exists, and a symbol position selector 26 arranged to select one or more display positions, in this example after a trigger condition is determined to exist, for example using the random number generator 22. After selection of one or more display positions, the function allocator 24 allocates a WILD function to each of the symbols displayed at the selected display positions, and also allocates a WILD function to any other displayed symbols that are the same as the symbols at the selected display positions. In this way, by randomly selecting one or more display positions, it is possible to add at least one WILD function to the displayed symbols in a way that is dependent on the display positions and not directly dependent on the symbols.

The game controller 32 also comprises an outcome evaluator 28 which, in accordance with game instructions 18, determines game outcomes based on the symbols selected for display to the player by the symbol selector 20 after all reels have stopped spinning.

The game controller 32 also comprises an award allocator 29 arranged to allocate a prize to a player when a winning outcome exists, and a display controller 31 arranged to control the display 36.

In the present embodiment, the symbol selector 20, the trigger determiner 25, the function allocator 24, the reel controller 23, the symbol position selector 26, the outcome evaluator 28, and the award allocator 29 are at least partly implemented using the processor 40 and associated software although it will be understood that other implementations are envisaged.

The gaming system 10 can take a number of different forms.

In a first form, a player operable gaming device in the form of a stand alone gaming machine is provided wherein all or most components required for implementing the game are present in the gaming machine.

In a second form, a distributed architecture is provided wherein some of the components required for implementing the game are present in a player operable gaming device and some of the components required for implementing the game are located remotely relative to the gaming device. For example, a "thick client" architecture may be used wherein part of the game is executed on a player operable gaming terminal and part of the game is executed remotely, such as by a gaming server; or a "thin client" architecture may be used wherein most of the game is executed remotely such as by a gaming server and a player operable gaming terminal is used only to display audible and/or visible gaming information to the player and receive gaming inputs from the player.

However, it will be understood that other arrangements are envisaged. For example, an architecture may be provided wherein a gaming device is networked to a device server and the respective functions of the gaming machine and the gaming server are selectively modifiable. For example, the gaming system may operate in stand-alone gaming machine mode, "thick client" mode or "thin client" mode depending on the game being played, operating conditions, and so on. Other variations will be apparent to persons skilled in the art.

Figure 3:
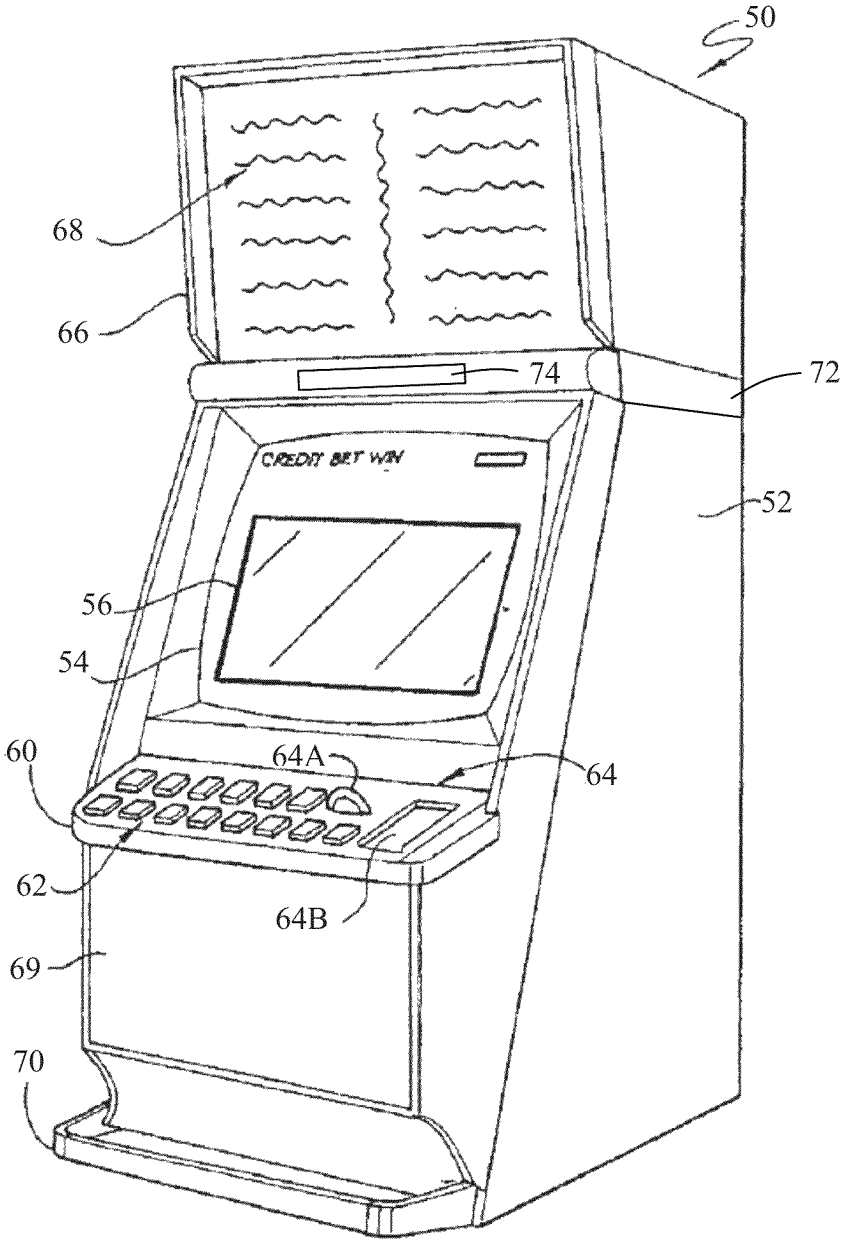
FIG. 3 is a diagrammatic representation of a gaming system in accordance with an embodiment of the present invention with the gaming system implemented in the form of a stand-alone gaming machine.

A gaming system in the form of a stand-alone gaming machine 50 is illustrated in FIG. 3. The gaming machine 50 includes a console 52 having a display 54 on which is displayed representations of a game 56 that can be played by a player. A mid-trim 60 of the gaming machine 50 houses a bank of buttons 62 for enabling a player to interact with the gaming machine, in particular during gameplay. The mid-trim 60 also houses a credit input mechanism 64 which in this example includes a coin input chute 64A and a bill collector 64B. Other credit input mechanisms may also be employed, for example, a card reader for reading a smart card, debit card or credit card.

A top box 66 may carry artwork 68, including for example pay tables and details of bonus awards and other information or images relating to the game. Further artwork and/or information may be provided on a front panel 69 of the console 52. A coin tray 70 is mounted beneath the front panel 69 for dispensing cash payouts from the gaming machine 50.

The display 54 is in the form of a video display unit, particularly a cathode ray tube screen device. Alternatively, the display 54 may be a liquid crystal display, plasma screen, or any other suitable video display unit. The top box 66 may also include a display, for example a video display unit, which may be of the same type as the display 54, or of a different type. The display 54 may comprise a touch screen usable by a player to interact with the gaming machine, in particular during game play.

The display 54 in this example is arranged to display representations of several reels, each reel of which has several associated symbols. Typically 3, 4 or 5 reels are provided. During operation of the game, the reels first appear to rotate then stop with typically three symbols visible on each reel. Game outcomes are determined on the basis of the visible symbols together with any special functions associated with the symbols.

A player marketing module (PMM) 72 having a display 74 is connected to the gaming machine 50. The main purpose of the PMM 72 is to allow the player to interact with a player loyalty system. The PMM has a magnetic card reader for the purpose of reading a player tracking device, for example as part of a loyalty program. However other reading devices may be employed and the player tracking device may be in the form of a card, flash drive or any other portable storage medium capable of being read by the reading device. In this example, the PMM 62 is a Sentinel III device produced by Aristocrat Technologies Pty Ltd.

The PMM 72 may be used to identify a player and in this way link the player to one or more games previously played by the player and for which the potential game benefit enhances with increasing game play and decreases as the time since ceasing game play increases.

Figure 4:
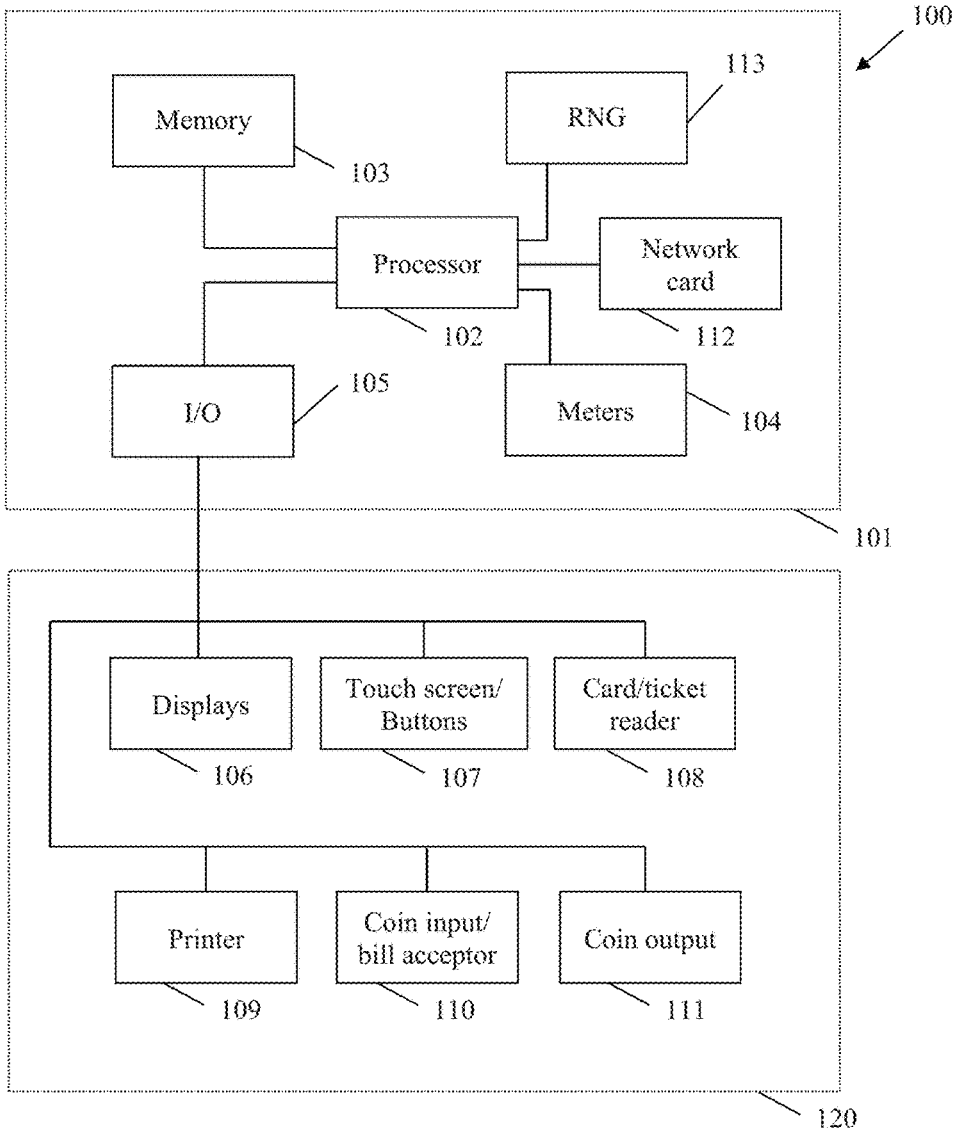
FIG. 4 is a schematic block diagram of operative components of the gaming machine shown in FIG. 3.

FIG. 4 shows a block diagram of operative components of a gaming device 100 which may be the same as or different to the gaming machine shown in FIG. 3.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 5:
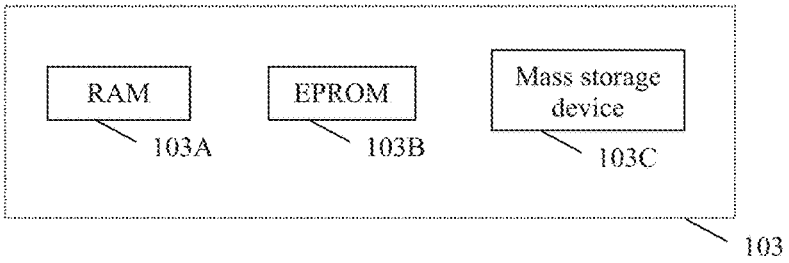
FIG. 5 is a schematic block diagram of components of a memory of the gaming machine shown in FIG. 3.

FIG. 5 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 4, the peripheral devices that communicate with the game controller 101 comprise one or more displays 106; a touch screen and/or bank of buttons 107 including at least one input device, such as at least one button, to enable a player to provide an indication as to whether the player wishes to keep symbols displayed in some of the reels or re-spin the reels; a card and/or ticket reader 108; a printer 109; a bill acceptor and/or coin input mechanism 110; and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106, 107, 108, 109, 110, 111 may be provided remotely from the game controller 101.

Figure 6:
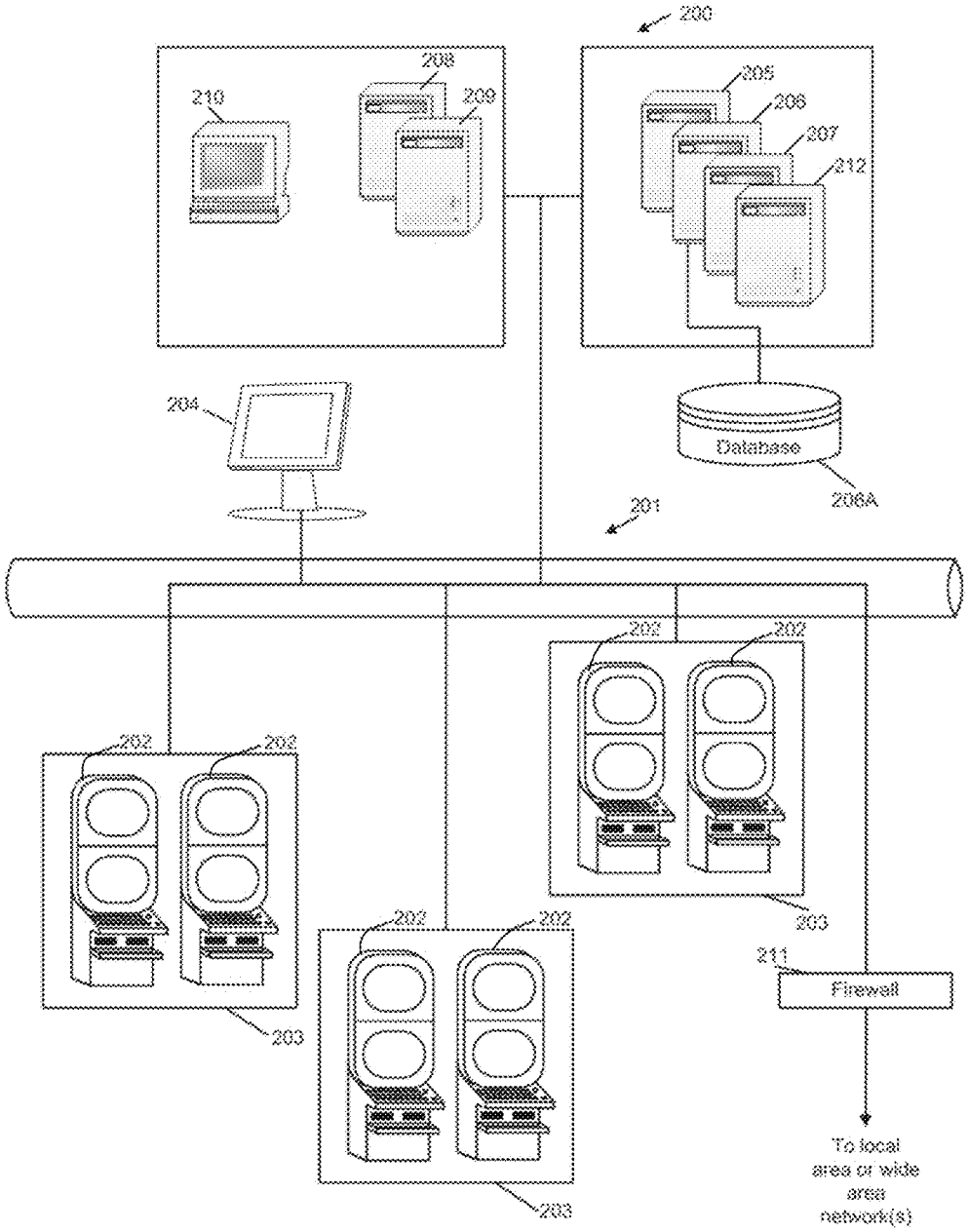
FIG. 6 is a schematic diagram of a gaming system in accordance with an alternative embodiment of the present invention wherein the gaming system is implemented over a network.

FIG. 6 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 40,100 shown in FIGS. 3 and 4, or may have simplified functionality depending on the requirements for implementing game play. While banks 203 of two gaming machines are illustrated in FIG. 6, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a variation of the above thick client embodiment, the gaming machine 202 may implement the game, with the game server 205 functioning merely to serve data indicative of a game to the gaming machine 202 for implementation.

With this implementation, a data signal containing a computer program usable by the client terminal to implement the gaming system may be transferred from the game server to the client terminal, for example in response to a request by the client terminal.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

A loyalty program server 212 may also be provided.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine.

Alternatively, a separate random number generator server could be provided.

Examples of specific implementations of the gaming system will now be described in relation to a stand-alone gaming machine 50 although it will be understood that implementation may also be carried out using other gaming system architectures such as a network architecture of the type shown in FIG. 6.

In this example, the gaming system comprises five reels, each reel corresponding to a display position group having an associated set of display positions for displaying symbols. The reels may be mechanical or virtual.

The reels are arranged to display standard symbols and one or more function symbols and win outcomes are determined on the basis of the symbols visible at the display positions when the reels stop.

Typically, a player will purchase or otherwise obtain win entitlements such as several win lines which are used in the game to determine win outcomes. If the displayed symbols on the reels have symbols associated with a winning combination such as a winning combination disposed on a win line, the player wins a prize.

In this example, the gaming system is operable in normal game mode and special game mode and may be arranged to commence special game mode when a trigger event occurs, such as a predetermined game outcome. Special game mode may comprise one or more free games. Special game mode may commence automatically on the basis of a game event occurring during a game such as display of a particular symbol, based on game outcomes determined by the gaming system, or may be prompted by a player pressing a button on the gaming system 10 after the player has identified that a game outcome corresponding to special game mode requirements has occurred.

The gaming system 10 may also be arranged so as to determine eligibility for special game mode, for example based on the amount or type of bet placed, based on particular time periods and so on.

Special game mode may also be arranged to commence when a special game is purchased by a player.

Figure 7:
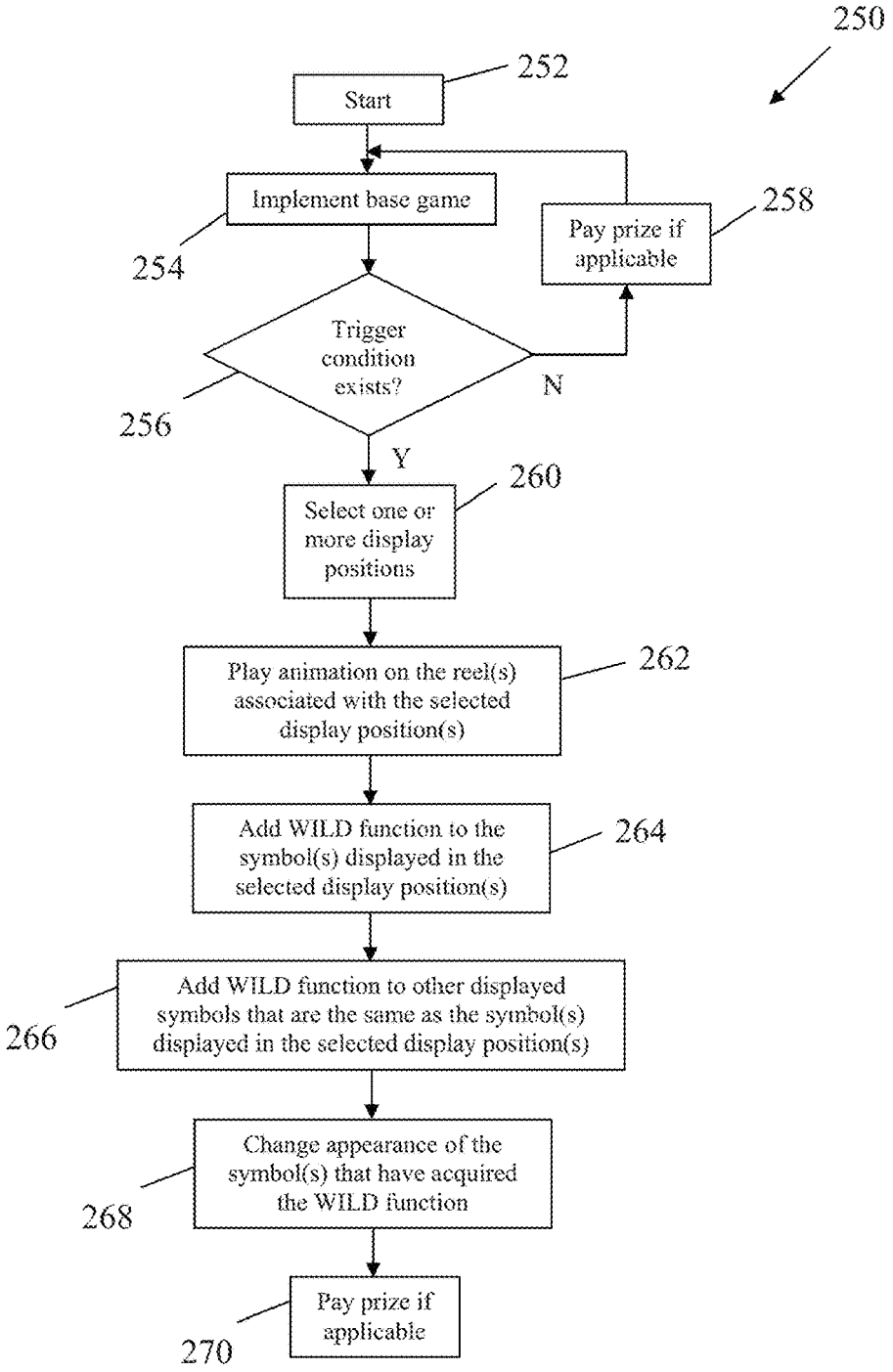
FIG. 7 is a flow diagram illustrating a method of gaming in accordance with an embodiment of the present invention.

A specific example will now be described in relation to flow diagram 250 shown in FIG. 7 which illustrates steps 252 to 270 of a method of gaming implemented by the gaming system according to the present embodiment. Example screens displayed to a player during game play are shown in FIGS. 8 and 9.

Figure 8:
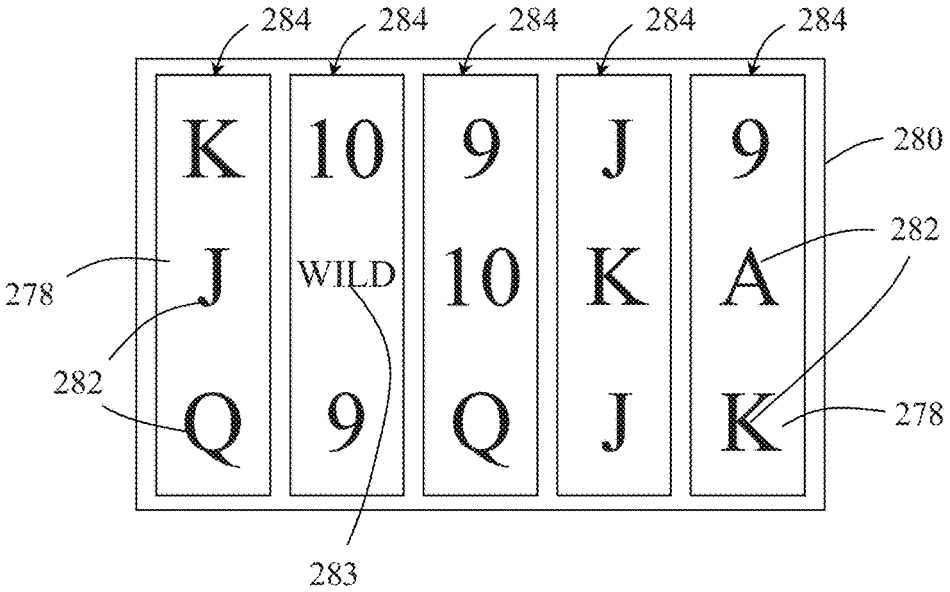
FIGS. 8, 9 and 10 are diagrammatic representations of a display area of a gaming system shown during implementation of embodiments of the invention.
Figure 9:
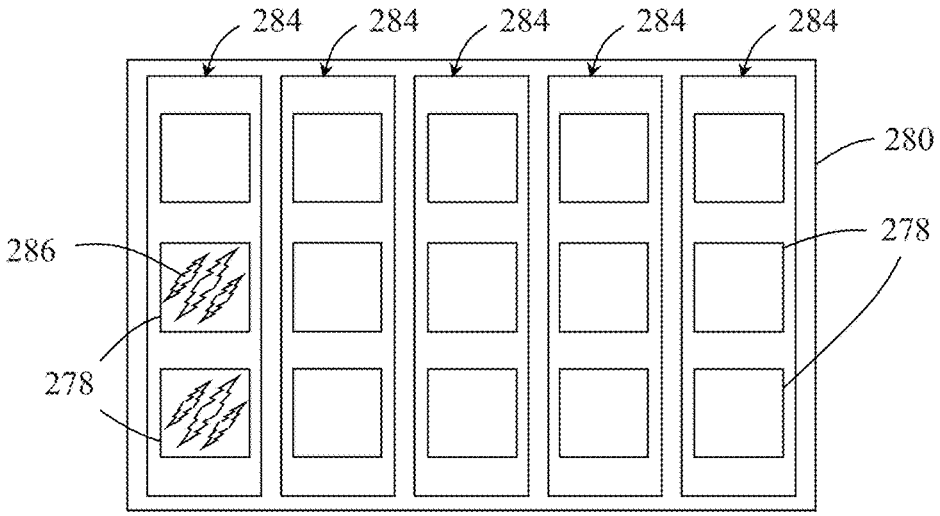

As shown in FIG. 8 and indicated at step 254, during normal game play a plurality of symbols are selected and displayed in a plurality of display positions 278 in a display area 280. In this example, the symbols include standard symbols 282 and function symbols 283 organized into a plurality of reels 284 that rotate and stop with 3 symbols displayed on each reel 284.

Each function symbol 283 has an associated function such as a WILD function, award multiplier, repeat win function or jackpot function, and the function may be applied to the game according to defined game rules. At least one function symbol 283 corresponds to a function that can have different levels of application, in the present example a WILD function that may apply a varying award multiplier, such as a 1×, 2× or 3× multiplier, during implementation of a base game and/or a feature game.

In this example, during game play, a base game is implemented 254 and a prize is awarded 258 if a winning outcome exists. Based on defined criteria, for example in response to a trigger condition 256 based on game play such as display of one or more specific symbols, special game mode commences wherein a feature game is implemented. During the feature game, the reels may be re-spun, and one or more display positions 278 are selected 260, in this example randomly using the random number generator 22, and the function allocator 24 allocates 264 a WILD function to the symbols displayed at the selected display position(s) 278.

In this example 2 display positions 278 are selected, although it will be understood that any number of display position selections is envisaged. The actual number of display position selections may be predetermined or determined randomly, for example using the random number generator 22. Also in this example, the display positions 278 are selected from a leftmost reel 284 only, although it will be understood that the display positions 278 may be selected from any reel 284 or any combination of reels 284, for example randomly using the random number generator 22.

After selection of the display positions 278, an animation may be displayed 262, for example in the form of a tiger strike representation 286 at each selected display position 278.

The function allocator 24 also allocates 266 a WILD function to other displayed symbols 282 that are the same as one of the symbols 282 displayed at the selected display positions 278.

Figure 10:
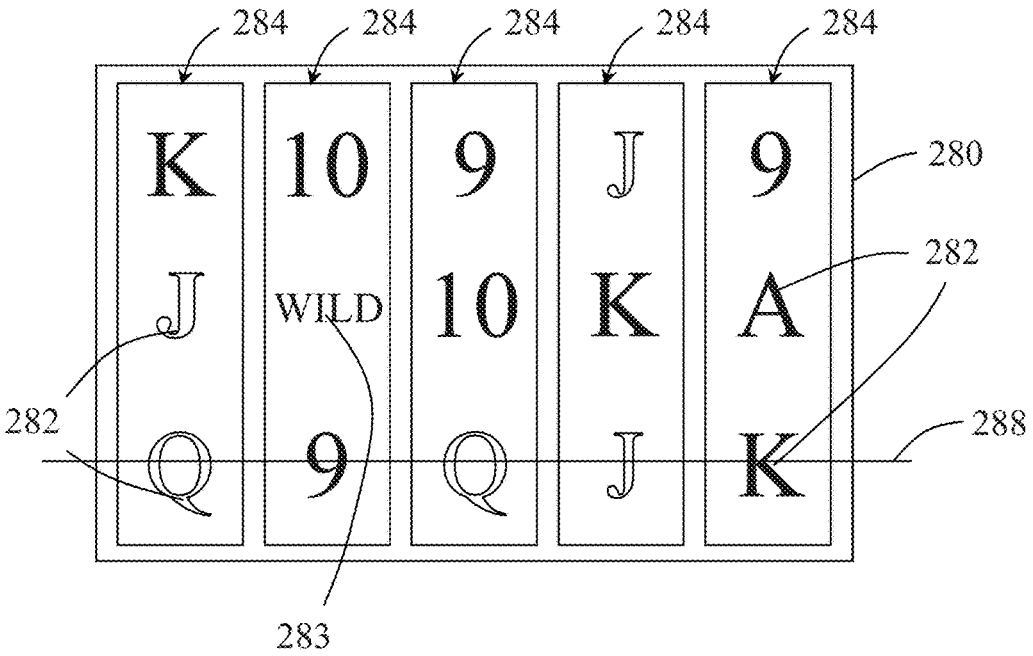

As shown in FIG. 10, in this example the appearance of the symbols 282 disposed at the selected display positions 278 is modified 268 so as to indicate to a player that the symbols 282 have acquired a WILD function. FIG. 10 also shows that the appearance of the other displayed symbols that are the same as the symbols disposed in the selected display positions 278 is also modified 268. In this example, the modification changes the colour of the relevant symbols to gold.

The displayed symbols are then evaluated and if a winning outcome exists a prize is awarded 270.

In the present example, J and Q symbols on a leftmost reel are disposed in selected display positions 282 and as a consequence the appearance of the J and Q symbols in the leftmost reel is changed and the J and Q symbols acquire a WILD function. Other displayed J and Q symbols also acquire a WILD function and the appearance of these symbols is also modified. As shown in FIG. 10, since the J and Q symbols have acquired a WILD function, a winning outcome comprising four 9 symbols is considered to exist along a win line 288, and an appropriate prize for this is awarded.

In the present embodiment, the symbols that have acquired the WILD function will substitute for all symbols except scatter symbols that are typically used to trigger special game mode. However, in a variation, if a scatter symbol is disposed in a selected display position 282 then the displayed scatter symbols that have acquired a WILD function will substitute for all symbols including scatter symbols.

While the above embodiment is described in relation to a gaming system wherein virtual reels are displayed on a graphical display device, it will be understood that, as an alternative, physical reels may be provided instead of virtual reels. With this embodiment, physical shutters may be provided to selectively conceal or modify the appearance of one or more symbols on the reels.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art is referred to herein, such reference does not constitute an admission that the prior art forms a part of the common general knowledge in the art, in Australia or any other country.

Modifications and variations as would be apparent to a skilled addressee are determined to be within the scope of the present invention.

The invention claimed is:

1. A gaming machine comprising:

a credit input mechanism configured to receive a physical item representing a monetary value to establish a credit balance, the credit balance being increasable and decreasable based at least on wagering activity;

a credit meter configured to monitor the credit balance;

a memory storing a set of symbols including a first symbol;

a display area having a plurality of display positions;

a selector configured to, in accord with the wagering activity, select a plurality of symbols from the set of symbols for display in respective display positions in the display area;

a display position selector configured to select a first display position, the selected first display position displaying the first symbol;

a function allocator configured to allocate a WILD function to the first symbol displayed at the selected first display position and to allocate the WILD function to a second display position that also displays the first symbol;

an outcome evaluator configured to determine a game outcome based on the displayed symbols and the allocated WILD function;

an award allocator configured to allocate an award based on the game outcome determined by the outcome evaluator; and a payout mechanism configured to provide a payout based on the allocated award.

2. The gaming machine as claimed in claim 1, wherein the symbols are displayed in a plurality of display position groups, and the display position selector is configured to select the first display position from a defined one or more of the display position groups.

3. The gaming machine as claimed in claim 1, wherein the symbols are displayed in a plurality of display position groups, and the gaming machine is configured to select one or more of the display position groups from which the display position selector selects the first display position.

4. The gaming machine as claimed in claim 2, wherein the display position groups are associated with a respective plurality of rotatable reels.

5. The gaming machine as claimed in claim 3, wherein the gaming machine is configured to randomly select one or more of the display position groups.

6. The gaming machine as claimed in claim 1, wherein the display position selector is configured to randomly select the first display position.

7. The gaming machine as claimed in claim 1, wherein the display position selector is configured to determine a number of selections of the first display position.

8. The gaming machine as claimed in claim 7, wherein the display position selector is configured to randomly determine the number of selections of the first display position.

9. The gaming machine as claimed in claim 1, wherein the gaming machine is configured to modify a first appearance of the first symbol displayed at the selected first display position.

10. The gaming machine as claimed in claim 9, wherein the gaming machine is configured to modify a second appearance of the first symbol at the second display position.

11. The gaming machine as claimed in claim 9, wherein the first appearance is modified by changing the a color of the first symbol.

12. The gaming machine as claimed in claim 1, wherein the gaming machine is configured to display an animation to indicate that the first display position has been selected.

13. A method of gaming for use with a gaming machine having a credit input mechanism configured to receive a physical item representing a monetary value to establish a credit balance, the credit balance being increasable and decreasable based at least on wagering activity, a credit meter configured to monitor the credit balance, a memory storing a set of symbols including a first symbol, a display area having a plurality of display positions, a payout mechanism, and a game controller, the method comprising:

selecting, in accord with the wagering activity, via the game controller, a plurality of symbols from the set of symbols for display in respective display positions in the display area;

selecting, via the game controller, a first display position;

allocating, via the game controller, a WILD function to the first symbol displayed at the selected first display position, the selected first display position displaying the first symbol;

allocating, via the game controller, the WILD function to the first symbol displayed at the selected first display position and to a second display position that also displays the first symbol;

determining, via the game controller, a game outcome based on the displayed plurality of symbols and the allocated WILD function;

allocating, via the game controller, an award based on the game outcome determined by the game controller; and providing a payout via the payout mechanism based on the allocated award.

14. The method as claimed in claim 13, further comprising displaying the symbols in a plurality of display position groups, and selecting the first display position from a defined one or more of the display position groups.

15. The method as claimed in claim 13, further comprising displaying the symbols in a plurality of display position groups, and selecting one or more of the display position groups from which the game controller selects the first display position.

16. The method as claimed in claim 14, wherein the display position groups are associated with a respective plurality of rotatable reels.

17. The method as claimed in claim 15, further comprising randomly selecting one or more of the display position groups.

18. The method as claimed in claim 13, further comprising randomly selecting the first display position.

19. The method as claimed in claim 13, further comprising determining a number of selections of the first display position.

20. The method as claimed in claim 19, further comprising randomly determining the number of selections of the first display position.

21. The method as claimed in claim 13, further comprising modifying a first appearance of the first symbol displayed at the selected first display position.

22. The method as claimed in claim 21, further comprising modifying a second appearance of the first symbol at the second display position.

23. The method as claimed in claim 21, further comprising modifying the first appearance by changing a color of the first symbol.

24. The method as claimed in claim 13, further comprising displaying an animation to indicate that the first display position has been selected.

* * * * *